United States Patent [19]

Buoni

[11] Patent Number: 4,902,003

[45] Date of Patent: Feb. 20, 1990

[54] EXERCISE DEVICE AND METHOD

[76] Inventor: Nick J. Buoni, 3655 Southern, Apt. D, Memphis, Tenn. 38111

[21] Appl. No.: 778,665

[22] Filed: Sep. 23, 1985

[51] Int. Cl.[4] ..... A63B 23/02

[52] U.S. Cl. ..... 272/93; 297/258

[58] Field of Search ..... 272/33 R, 144, 145, 272/93, 146, 56, 127; 297/258, 260, 272; D21/237; 128/68, 69

[56] References Cited

U.S. PATENT DOCUMENTS

| | | | |
|---|---|---|---|
| 3,235,253 | 2/1966 | Glass et al. | 272/144 X |
| 4,109,960 | 8/1978 | Stidchfield | 297/258 |
| 4,210,322 | 7/1980 | Pritchard | 272/144 X |
| 4,230,099 | 10/1980 | Richardson | 128/69 |
| 4,241,949 | 12/1980 | Parker | 297/258 X |
| 4,258,952 | 3/1981 | Dutra | 297/258 |
| 4,367,870 | 1/1983 | Birch | 272/144 |

FOREIGN PATENT DOCUMENTS

| | | | |
|---|---|---|---|
| 3326078 | 1/1985 | Fed. Rep. of Germany | 272/127 |

OTHER PUBLICATIONS

Advertisement for the "Tommy Former", Got in Form, Magazine, p. 42, T2-1983.

*Primary Examiner*—Richard J. Apley
*Assistant Examiner*—R. Bahr
*Attorney, Agent, or Firm*—Walker & McKenzie

[57] ABSTRACT

An exercise device and method for sit-up type exercises. The exerciser's back is maintained in a forwardly curved position with the knees bent and the feet resting on the floor while the exerciser rocks forwardly to stress the abdominal muscles. The device includes a curved support surface on which the exerciser is supported with the back forwardly curved, and includes base structure which allows the support surface to rock back and forth with the exerciser whereby the exerciser's back stays forwardly curved.

3 Claims, 2 Drawing Sheets

EXERCISE DEVICE AND METHOD

BACKGROUND OF THE INVENTION

1. Field of the Invention: The present invention relates in general to an exercise device and a method of exercising especially adapted for sit-up type exercises.

2. Description of the Prior Art: Numerous devices have heretofore been developed for use in exercising. Bruder, U.S. Pat. No. 1,904,039 discloses a contoured pad which is shaped to conform substantially to the longitudinal curvature of the back of a person on which a person lays which exercising. Williams, U.S. Pat. No. 3,102,280 discloses a buoyant exercising device for supporting a person on a body of water as the person exercises by rocking the device on the body of water. Kupchinski, U.S. Pat. No. 3,378,259 discloses an exercising cot for supporting a person in a reclined position to enable the person to exercise by bending at the waist, sides and hip regions. Birch, U.S. Pat. No. 4,367,870 discloses an exercising device comprising a rockable structure which allows a person to sit on a portion thereof and rock backward into a shoulder stand position.

It has long been known that sit-up type exercise are beneficial to the abdominal area. However, it is now known that the standard sit-up conditioning exercise consisting of raising the trunk to a sitting position from a supine position with the legs remaining straight causes undue stress and trauma to the lower back regions.

Thus, the "perfect" sit-up is not considered to be done with the knees bent and the back always curved. Further, the most desirable sit-up is now considered to be the "crunch" style sit-up consisting of raising the trunk only a slight amount with the knees bent and the back always curved and with the abdominal muscles tensed.

Summary of the Invention

The present invention is directed toward providing a device and a method of performing crunch style sit-ups in which an exerciser is automatically put in the proper knees bent, back always curved position. The concept of the present invention is to support the exerciser in the knees bent, back always curved position with a device that allows the exerciser to rock forward in a rocking chair type motion thereby putting pressure on the exerciser's abdominal muscles.

The present invention comprises, in general, a support means for supporting an exerciser's body with the back curved forwardly, with the knees bent and with the feet resting on a support surface; and base means attached to the support means for allowing the exerciser to rock the shoulders forwardly to stress the abdominal muscles while the support means prevents the back from straightening from the curved forward position with the knees bent and the feet on the support surface.

One objective of the present invention is to provide an exercise device that works on the rocking chair theory and that forces an exerciser to do the perfect sit-up with the knees bent and the back always curved.

Another objective of the present invention is to allow an exerciser to do crunch style sit-ups by merely raising the shoulders further from the support means when rocking forward.

Another objective of the present invention is to provide a light weight and very portable sit-up exercise device.

Another objective of the present invention is to provide a sit-up type exercise device that can be used by everyone including children and senior citizens.

Another objective of the present invention is to provide a sit-up type exercise device that allows a high repetition, aerobic workout.

Another objective of the present invention is to provide a low cost, easily manufactured, durable exercise device.

DESCRIPTION OF THE PREFERRED EMBODIMENT

The exercise device 11 of the present invention is for use by an exerciser 13 doing sit-up type exercises.

Figure 1:
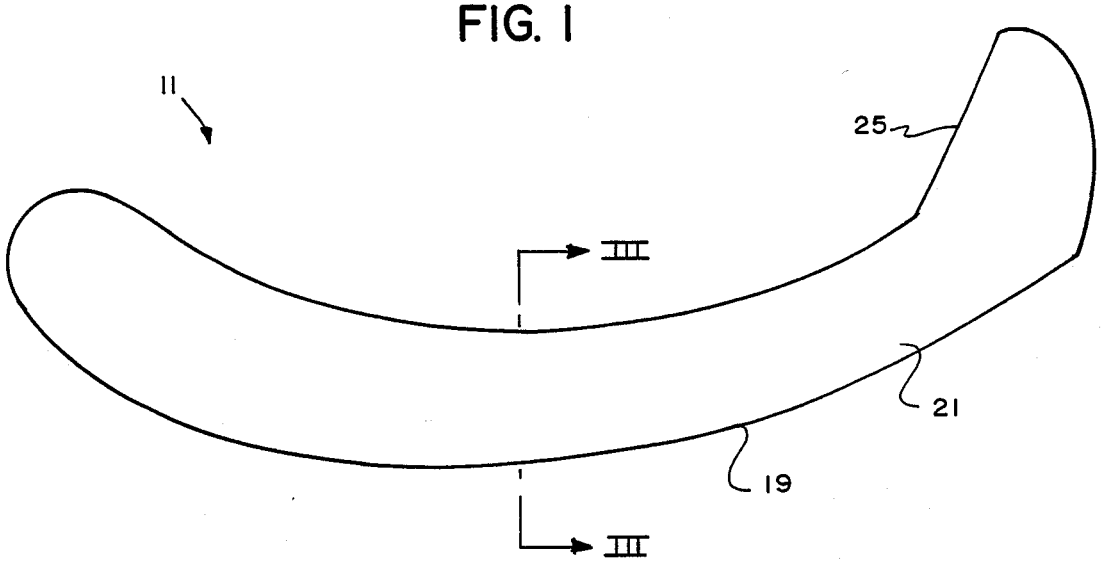
FIG. 1 is a front elevational view of the exercise device of the present invention.
Figure 2:
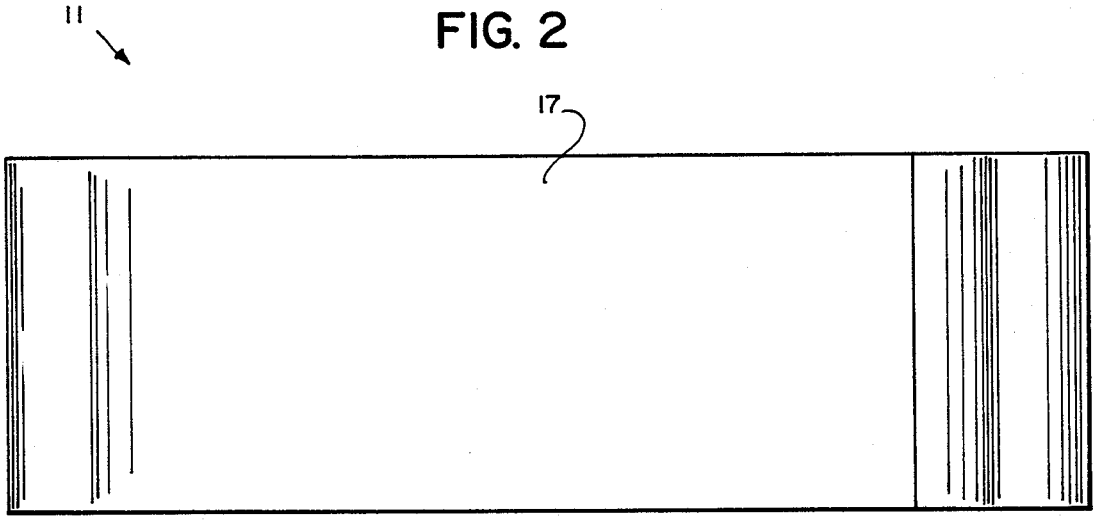
FIG. 2 is a top plan view thereof.
Figure 3:
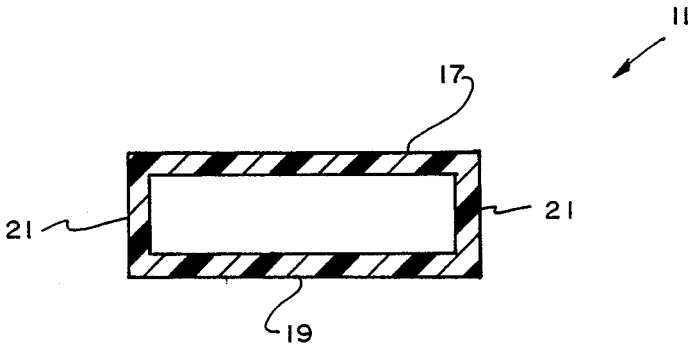
FIG. 3 is a sectional view substantially as taken on line III—III of FIG. 1.
Figure 4:
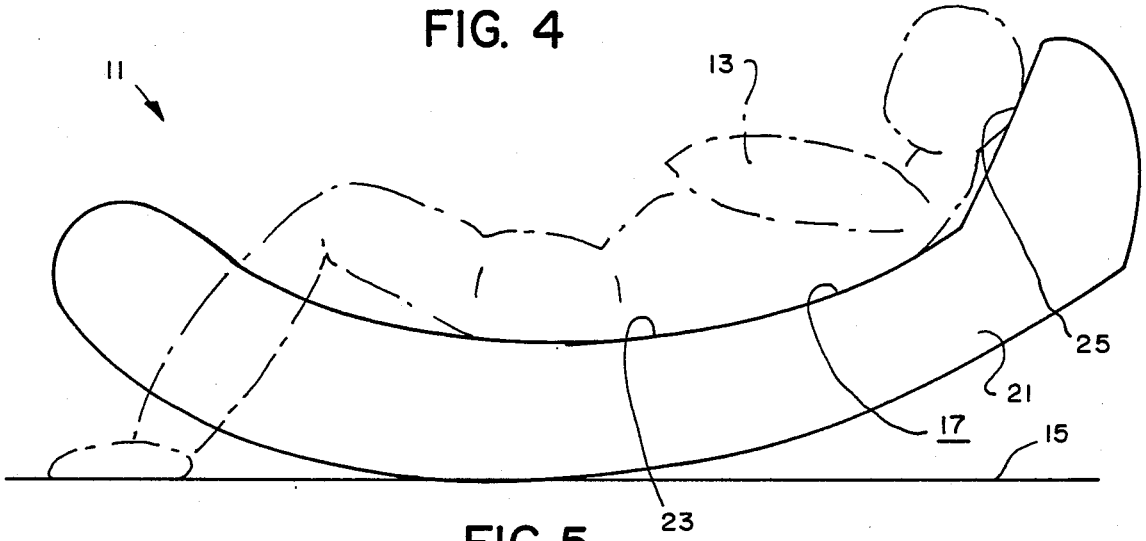
FIG. 4 is a front elevational view thereof shown on a supporting surface with an exerciser positioned thereon.
Figure 5:
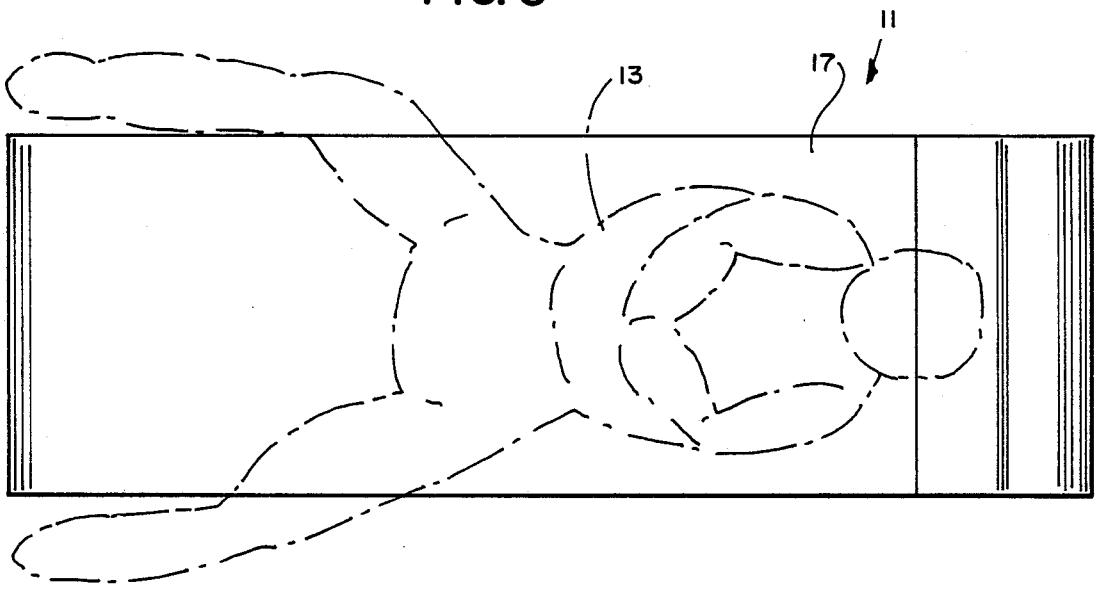
FIG. 5 is a top view of FIG. 4.

The exercise device 11 includes, in general, a support means for supporting the body of the exerciser 13 and a base means attached to the support means for allowing the support means to rock back and forth on a supporting surface such as a floor surface 15. The support means has a curved supporting surface 17 on which the trunk of the exerciser 13 rests for causing the back of the exerciser 13 to curve forwardly and for preventing the back of the exerciser 13 from straightening from the curved forwardly position during sit-up type exercises. The base means has a curved rocking surface 19 for engaging the floor surface 15 and for allowing the exerciser 13 to rock the exercise device 11 on the floor surface 15 while doing sit-up type exercises. The specific construction of the exercise device 11 may vary. Thus, for example, the curved supporting surface 17 may consist of a rigid plate member constructed of wood or the like, the curved rocking surface 19 may consist of one or more curved rocker members similar to the rocker members of a typical rocking chair, and an open frame of wood or metal may be provided to join the curved supporting surface 17 and the curved rocking surface 19. However, the exercise device 11 is preferably constructed as an integral, one-piece unit out of molded plastic or the like with the curved supporting surface 17 and the curved rocking surface 19 rigidly joined to one another by integral wall members 21, etc. Thus, while the exercise device 11 may be constructed in many different manners, it is important that the curved supporting surface 19 be specifically designed to maintain the back of the exerciser 13 in a curved forwardly position as shown in FIG. 4 to prevent undue stress and strain from being applied to the lower back of the exerciser 13 when doing sit-up type exercises. Thus, the curved supporting surface 17 preferably includes a first curved portion 23 for supporting the majority of the trunk of the exerciser 13 and a second curved portion 25 having a "tighter" curve than the first curved portion 23 (i.e., having a smaller radius than the curve of the first curved portion 23) for supporting the head of the exerciser 13 as shown in FIG. 4—this insures that the exerciser 13 is held in the optimum position by the curved supporting surface 17 for doing sit-up type exercises.

Figure 6:
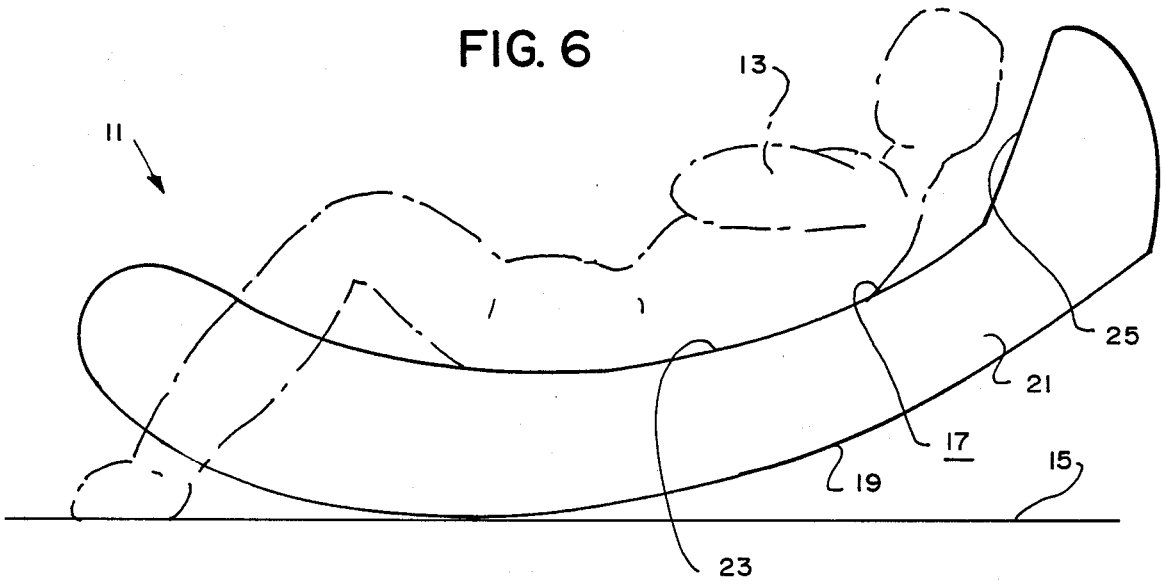
FIG. 6 is an elevational view similar to FIG. 4 but with the exerciser and exercise device in a rocked forwardly position.

The method of the present invention consists simply of the exerciser 13 resting on the curved supporting surface 17 as shown in FIG. 4 with the head of the exerciser 13 positioned at the second curved portion 25 and with the feet of the exerciser 13 positioned on either side of the exercise device 11 resting on the floor surface 15. To exercise the exerciser 13 merely rocks forwardly putting pressure on the abdominal muscles. To add more pressure to the abdominal muscles, the exerciser raises the head forwardly away from the curved supporting surface 17 when rocking forward as shown in FIG. 6 thereby doing a crunch style sit-up. The above motions can be repeated numerous times with the knees bent, the feet on the floor and the back always curved whereby the lower back will not be unduly stressed or strained. When the muscles begin to tire and burn, instead of stopping the exerciser can merely relax the abdominal muscles, still rocking but keeping the head against the curved supporting surface 13 until the muscles are strong enough to rock forward with more pressure. By using this rocking method and by being able to control the pressure on the abdominal muscles, the exerciser can literally do hundreds of crunch style sit-ups.

Although the present invention has been described and illustrated with respect to a preferred embodiment and a preferred use, it is not to be so limited since changes and modifications can be made therein which are within the full intended scope of the invention.

I claim:

1. An exercise device for use by an exerciser doing sit-up type exercises to stress the exerciser's stomach muscles, said device comprising:

(a) support means for supporting the exerciser's body with the majority of the exerciser's trunk maintained at a first curve and with the exerciser's neck maintained at a second curve having a smaller radius than said first curve as the exerciser does sit-up type exercises, said support means having a curved supporting surface for causing the exerciser's back to curve forwardly and for preventing the exerciser's back from straightening from the curved position during the sit-up type exercises, said curved supporting surface having a first curved position for supporting the majority of the exerciser's trunk and a second curved portion for supporting the exerciser's head, said second curved portion having a smaller radius than said first curved portion; and (b) base means attached to said support means for allowing said support means to rock back and forth on a floor surface along a plane substantially aligned with the longitudinal axis of the exerciser's trunk while preventing said support means from rocking back and forth on the floor surface along any plane not substantially aligned with the longitudinal axis of the exerciser's trunk as the exerciser does sit-up type exercises and for allowing the exerciser's shoulder to rock forward while preventing the exerciser's back from straightening from the curved forwardly position, while keeping the exerciser's knees bent and while keeping the exerciser's feet on the floor surface.

2. The device of claim 1 in which said base means has a curved rocking surface for resting on the floor surface.

3. A method of exercising an exerciser's abdominal muscles, said method comprising the steps of:

(a) rigidly supporting the exerciser's body with the back curved forwardly with the majority of the trunk of the exerciser's back maintained at a first curve, with the exerciser's head maintained at a second curve having a smaller radius than said first curve, with the exerciser's knees bent and with the exerciser's feet resting on a support surface; and then (b) rocking the trunk back and forth along a plane substantially aligned with the longitudinal axis of the trunk while preventing the trunk from rocking along any plane not substantially aligned with the longitudinal axis thereof while preventing the back and head from straightening from the curved position while keeping the knees bent and while keeping the feet on the support surface.

* * * * *